US011611150B2

(12) United States Patent
Matitsine et al.

(10) Patent No.: US 11,611,150 B2
(45) Date of Patent: Mar. 21, 2023

(54) ANISOTROPIC LENSES FOR REMOTE PARAMETER ADJUSTMENT

(71) Applicant: Matsing, Inc., Irvine, CA (US)

(72) Inventors: Serguei Matitsine, Dallas, TX (US); Igor Timofeev, Dallas, TX (US); Leonid Matytsine, Irvine, CA (US)

(73) Assignee: Matsing, Inc., Irvine, CA (US)

( * ) Notice: Subject to any disclaimer, the term of this patent is extended or adjusted under 35 U.S.C. 154(b) by 0 days.

(21) Appl. No.: 17/071,965

(22) Filed: Oct. 15, 2020

(65) Prior Publication Data

US 2021/0111496 A1 Apr. 15, 2021

Related U.S. Application Data

(60) Provisional application No. 62/978,701, filed on Feb. 19, 2020, provisional application No. 62/915,293, filed on Oct. 15, 2019.

(51) Int. Cl.

| | |
|---|---|
| ***H01Q 3/46*** | (2006.01) |
| ***H01Q 19/06*** | (2006.01) |
| ***H01Q 3/14*** | (2006.01) |

(52) U.S. Cl.

CPC ..... *H01Q 19/062* (2013.01); *H01Q 3/14* (2013.01)

(58) Field of Classification Search

CPC ..... H01Q 3/14; H01Q 19/062; H01Q 3/45; H01Q 15/02; H01Q 19/06; H01Q 25/007

See application file for complete search history.

(56) References Cited

U.S. PATENT DOCUMENTS

| | | | | |
|---|---|---|---|---|
| 5,821,908 | A | 10/1998 | Sreenivas | |
| 6,020,850 | A * | 2/2000 | Ji | H01Q 3/2676 342/368 |
| 7,605,768 | B2 | 10/2009 | Ebling et al. | |
| 9,761,941 | B2 | 9/2017 | Griffith et al. | |
| 2007/0296640 | A1 | 12/2007 | Colburn et al. | |
| 2017/0062944 | A1* | 3/2017 | Zimmerman | H01Q 19/062 |
| 2017/0324171 | A1 | 11/2017 | Shehan | |
| 2018/0097290 | A1 | 4/2018 | Matitsine et al. | |
| 2018/0183152 | A1 | 6/2018 | Turpin et al. | |
| 2018/0337442 | A1* | 11/2018 | Deng | H01Q 1/246 |
| 2019/0317210 | A1 | 10/2019 | Fillion | |

FOREIGN PATENT DOCUMENTS

EP 1005104 A1 5/2000

OTHER PUBLICATIONS

"Technical Note: Beam Shaping with Cylindrical Lenses", https://www.newport.com/n/beam-shaping-with-cylindrical-lenses, 2 pages.
US Electrodynamics Inc., Teleport, Apr. 2018, 2 pages.
International Search Report and Written Opinion for International Application No. PCT/US2020/055859 dated Feb. 8, 2021,11 pages.

* cited by examiner

*Primary Examiner* — Awat M Salih
(74) *Attorney, Agent, or Firm* — Fish IP Law, LLP

(57) ABSTRACT

One or more anisotropic lenses, where the permittivity and/or permeability is directional, are used to vary one or more of beamwidth, beam direction, polarization, and other parameters for one or more antennas. Contemplated anisotropic lenses can include conductive or dielectric fibers or other particles. Lenses can be spherical, cylindrical or have other shapes depending on application, and can be rotated and/or positioned. Important applications include land and satellite communication, base station antennas.

28 Claims, 20 Drawing Sheets

ANISOTROPIC LENSES FOR REMOTE PARAMETER ADJUSTMENT

This application claims priority to the following cases: U.S. provisional application Ser. No. 62/915,293 filed Oct. 15, 2019, entitled "ANISOTROPIC LENSES FOR REMOTE PARAMETER ADJUSTMENT", and U.S. provisional application Ser. No. 62/978,701 filed Feb. 19, 2020, entitled "ANISOTROPIC LENSES FOR REMOTE PARAMETER ADJUSTMENT". This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is wireless communication.

BACKGROUND

The background description includes information that may be useful in understanding the present invention. It is not an admission that any of the information provided herein is prior art or relevant to the presently claimed invention, or that any publication specifically or implicitly referenced is prior art.

Antennas in future telecommunication networks are expected to present high gain in a broadband frequency range, as well as a reconfigurable radiation pattern. This is of particular interest for 5G systems which require greater thru-put and more precise optimization for peak performance. Currently there are limited methods of being able to electronically control and adjust this beamwidth without changing the antenna.

By common definition, antenna reconfigurability is remote/dynamic control of such antenna parameters as gain, radiation pattern (including beamwidth and beam shape), number of beams, polarization, with reversible modifications of its properties. The reconfiguration capability of reconfigurable antennas is used to maximize the antenna performance in a changing scenario or to satisfy changing operating requirements.

In many cases, previously deployed three-sector antennas will upgrade to nine-sector antennas to increase capacity. For example, there is demand for reconfigurable antennas with ability to change one wide beam (covering 120° sector) to multiple beams, which together provide the same 120° coverage. Also, in some wireless scenarios, beamwidth of an antenna might need to be dynamically adjusted (for example, from standard 65° 3 dB BW to 30° 3 dB BW) for coverage optimization/improvement.

In the telecommunication industry, typically BSA antennas are used (consisting of multiple radiating elements phased together into a phased array antenna), these antennas provide coverage for cellular use. It is well known that adjusting this coverage (i.e., adjusting the vertical/horizontal beamwidth of the antenna) can be a useful tool in optimizing capacity and coverage of users.

One possible method of adjusting resultant beamwidth is applying an isotropic dielectric lens in front of the radiating element or antenna. An isotropic spherical dielectric lens 101 is shown in prior art FIG. 1. Lens 101 has equal magnitude of dielectric constant (DK) in all axes (X, Y, Z). However, this method does not provide a solution for variable beamwidth, as well as the ability to adjust only the horizontal or vertical beam. Reconfiguring for different beamwidths using isotropic dielectric lenses requires the use of a new antenna, and therefore fails to provide a standard solution which can be used on different types of existing BSA antennas.

Polarization diversity and MIMO performance can be also improved by use of polarization agility (in particular, with circular polarization). The additional antenna gain and degrees of freedom (pattern, polarization) provided by reconfigurable antennas can be used to overcome significant path loss and shadowing, especially at higher frequencies (5G), and for better in-building penetration. Accordingly, there is still a need for an antenna system that solves these problems to provide high performance base station antenna with adjustable number of beams and pattern/polarization reconfigurability.

Thanks to the invention of light-weight, low loss, low cost artificial dielectric material (see, e.g., U.S. Pat. No. 8,518,537 to Matitsine) lensed antennas are used more widely in advanced 4G/LTE wireless communications. This provides better coverage and capacity compared to traditional antenna arrays, see e.g., https://matsing.com Lensed antennas also open doors to antenna reconfigurability, because the advancement in wireless communications requires the integration of multiple radios into a single platform to maximize connectivity and capacity. The '537 patent describes many different materials that can be used in lensed antennas, and such materials are referred to herein as "Matsing materials".

U.S. Pat. No. 9,819,094 to Matitsine et al., provides good examples of advanced base station lensed antennas, but such antennas do not have reconfigurability (i.e. pattern, gain, polarization cannot be dynamically adjusted), because the lens uses isotropic dielectric materials (i.e. material has the same dielectric constant in any direction, X, Y, Z).

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

SUMMARY OF THE INVENTION

This application describes apparatus and methods in which one or more anisotropic lenses are used to vary one or more of beamwidth, beam direction, polarization, and other parameters for BSA and other types of antennas.

As shown below, the above-mentioned requirements to reconfigurable antennas can be achieved by moving of anisotropic dielectric body (bodies) near the antenna aperture. Although this method of antenna reconfigurability looks universal, it is illustrated below with application to base station antenna technology. Artificial anisotropic dielectric material is much less expensive and lighter compare to natural anisotropic dielectric material.

Anisotropic lenses with varying magnitude of dielectric value (DK) in relation to the direction of the applied electric field are described, as well as lenses with varying magnetic constant (permeability) in relation to the direction of the applied magnetic field. Key practical antenna applications such as variable beamwidth (or beamforming) for all types of 4G/LTE/5G BSA antennas are presented. For antenna applications, different shaped (cylindrical, spherical, disc, rectangular) anisotropic dielectric lenses are described that can be used to adjust single or multiple antenna parameters. Parameters include being able to adjust the resultant beamwidth, beam direction, polarization, gain, and sidelobe levels for single and multiple resultant antenna beams. Depending on the shape and DK orientation used, the lens can be mechanically rotated or moved to gradually increase/decrease the resultant beamwidth as well as other parameters of the antenna.

Furthermore, different types of materials and methods of fabrication are given. Some contemplated embodiments use spherical lenses constructed using a light weight polymer based material with embedded conductive fibers oriented in a single direction. Other contemplated embodiments use conductive fibers oriented in different orientations. Multiple examples are given including spherical lenses used to adjust resultant beamwidth of single-polarization antennas, dual-polarization antennas as well as multi-beam antennas. Further examples are given for independent horizontal and vertical beamwidth adjustment, as well as simultaneous horizontal and vertical beamwidth adjustment.

As a solution for remote adjustment of antenna parameters, methods of remote adjustment such as mechanical movement or rotation of lenses and electronic movement and/or rotation of lenses are discussed. Examples of adjustment of other antenna parameters such as beam direction are also provided. Other applications can include radar, satellite, as well as magnetic anisotropic lenses for multiple applications.

Although in many instances it might be preferable to move one or more lenses relative to one or more radiating elements, the physics is such that moving an element relative to a lens can achieve the same goal. Accordingly, this application uses the term "mutually orienting" with respect to lenses and radiating elements to include situations where either or both of a radiating element or a lens is being moved or otherwise oriented. And any description of either one of a radiating element or its associated lens being moved or oriented should be interpreted as if the description had specified "mutually orienting".

In a preferred embodiment, an antenna system includes at least one spherical lens, each having a first dielectric permittivity in a first direction and a second dielectric permittivity in a second direction, where the lens is coupled to at least one radiating element. The anisotropic lens advantageously allows for adjustment of the resultant output beamwidth, output beam direction, output beam polarization, output beam gain, and output beam sidelobe levels. In some embodiments, the anisotropic lens can be substantially cylindrical, disc-shaped, or rectangular. As used herein, and unless the context dictates otherwise, the term "output beam" is intended to include the radiation pattern power contours, received into or transmitted out from the antenna or antenna system described, due to an RF signal resulting from any electromagnetic-based form of communication.

Thus, in first aspect of the present invention, rotation of an anisotropic body (in particular a cylinder with a plurality of parallel short wires) provides a base station antenna with pattern reconfiguration (including transformation from one beam to multi-beam operation) and limited polarization agility.

In a second aspect of present invention, rotation of anisotropic body (in particular, cylinder with plurality of crossed short wires) provides a base station antenna with full polarization agility.

In a third aspect of present invention, independent rotation of two anisotropic bodies (in particular, inner cylinder with plurality of crossed short wires and outer hollow cylinder with plurality of parallel short wires) provides full pattern reconfiguration (including single- and multi-beam operation) and full polarization agility.

Various objects, features, aspects and advantages of the inventive subject matter will become more apparent from the following detailed description of preferred embodiments, along with the accompanying drawing figures in which like numerals represent like components.

DETAILED DESCRIPTION

Exemplary Embodiments

Figure 1:
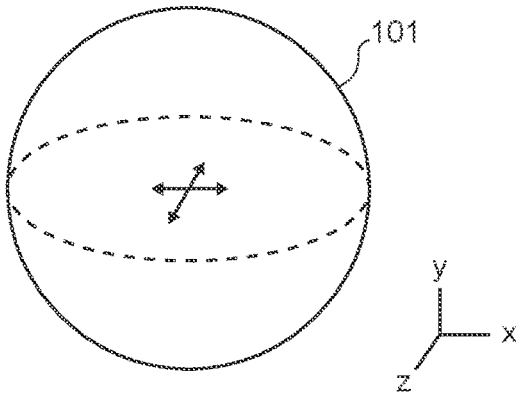
Fig. 1 (Prior Art)
FIG. 1 is a schematic of a prior art spherical isotropic lens.
Figure 2:
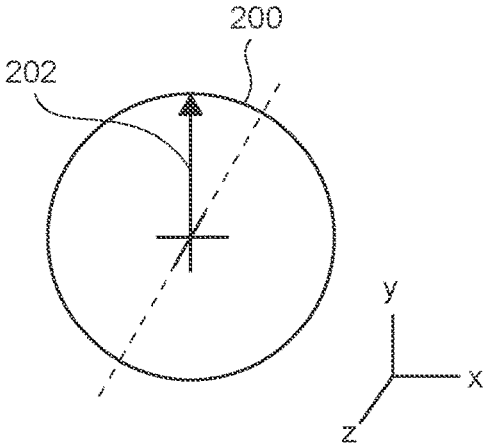
FIG. 2 is a schematic of a spherical anisotropic lens having a magnitude of DK (dielectric constant) oriented in the Y axis.

FIG. 2 is a simple embodiment in which a single spherical, anisotropic dielectric lens 200 has magnitude of DK (dielectric constant) oriented in the Y axis, as depicted by arrow 202.

Figure 3A:
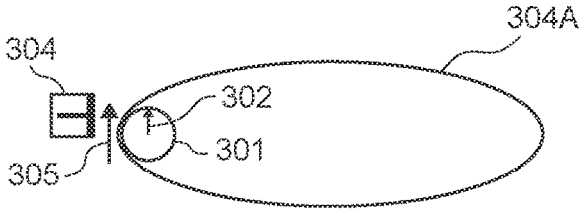
FIG. 3A is a schematic of a beam emanating from an anisotropic lens in which both the magnitude of the dielectric constant and the direction of the applied electric field from a radiating element are parallel.

FIG. 3A depicts a beam 304A emanating from a single radiating element 304, polarized in direction of arrow 305, to emit an applied electric field, and passing through an anisotropic lens 301 also oriented to have a main DK in a Y direction 302. At this orientation both the magnitude of the dielectric constant and the direction of the applied electric field from the radiating element are parallel in the vertical direction, and the resultant beam is horizontally relatively narrow.

Figure 3B:
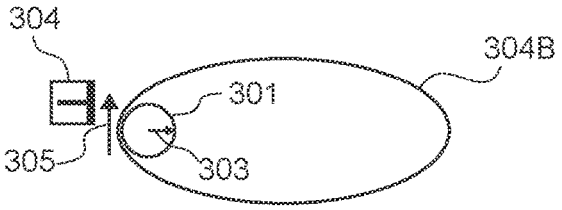
FIG. 3*b* is a schematic of a beam emanating from an anisotropic lens in which both the magnitude of the dielectric constant and the direction of the applied electric field from a radiating element are orthogonal.

FIG. 3B depicts a beam 304B emanating from a single radiating element 304, polarized in direction of arrow 305, to emit an applied electric field, and passing through an anisotropic lens 301, oriented to have a main DK in an X direction 303. At this orientation the magnitude of the DK and the direction of the applied electric field from the radiating element are orthogonal, and the resultant beam is horizontally relatively broader.

Figure 4:
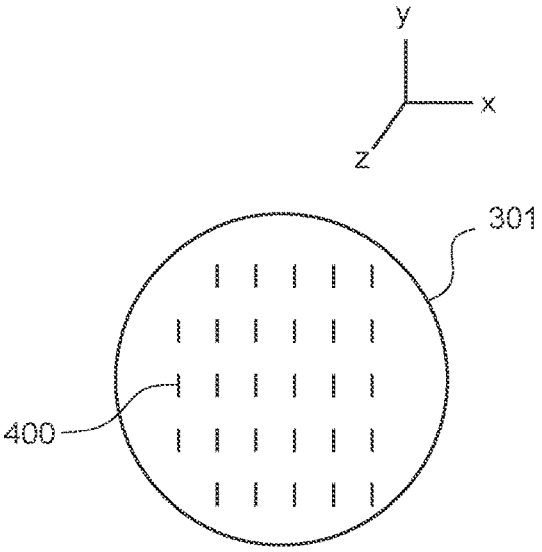
FIG. 4 is a schematic of a cross-section of an anisotropic lens having conductive fibers oriented in a single direction.

FIG. 4 depicts a cross-section of an anisotropic lens 301 showing orientation of substantially parallel fibers 400 in the Y direction, which can be rotated or moved along a plane that includes the fibers, either mechanically or electronically, to allow variable and remote adjustment of the beamwidth from a single polarization element. An exemplary lens of this type can be a spherical lens made from a light-weight polymer based material embedded with the conductive fibers.

Figure 5:
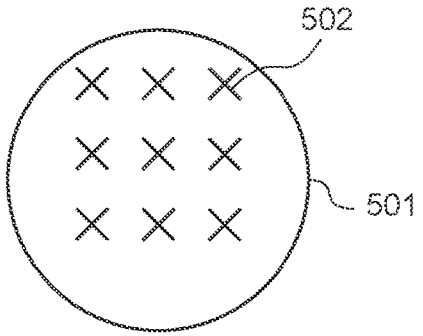
FIG. 5 is a schematic of conductive fibers in a lens, in which the fibers are positioned in orthogonal directions.

FIG. 5 depicts a lens 501 having fibers 502 positioned in orthogonal directions, in this case the DK values of the lens are oriented in both +45 and −45 directions. This provides a solution for adjusting beamwidth without changing resulting polarization of the beam for a dual polarization element. In other examples different orientations of DK can be used to variably adjust the resultant polarization.

Figure 6:
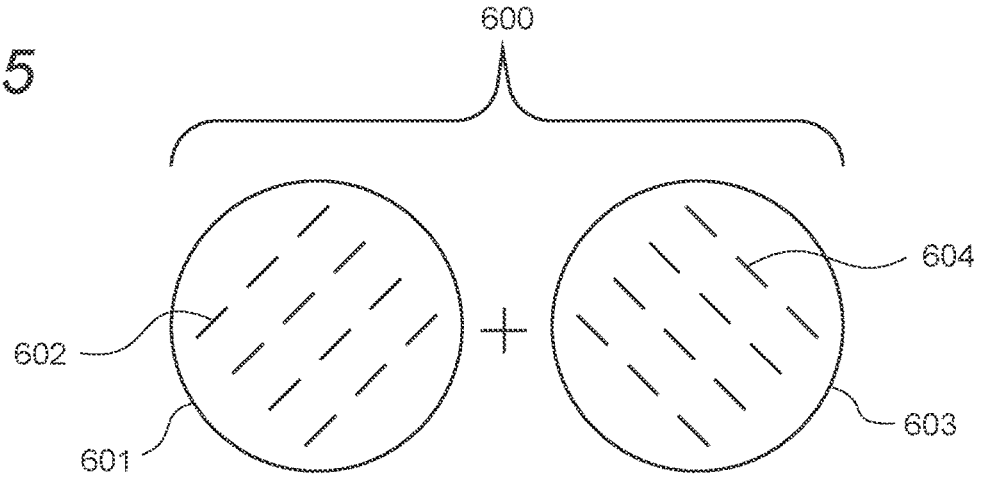
FIG. 6 is a schematic of a first and second discs of an anisotropic lens, in which the conductive fibers in the first disc is oriented orthogonally to those in the second disc.

It is also contemplated that a given anisotropic lens can have multiple orientations of DK values. For example, FIG. 6 depicts a lens 600 comprising disc 601 with fibers 602, and disc 603 with fibers 604. As shown, the fibers on the two discs are orthogonal, forming X shaped orientations. Discs 601 and 602 could be positionally fixed relative to one another, or rotatable relative to one another.

Figure 7:
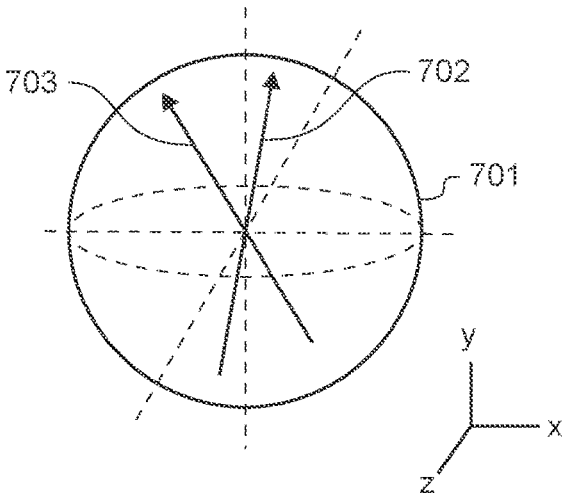
FIG. 7 is a schematic of an anisotropic lens having magnitude of DK orientated in multiple directions (+45 and −45).

FIG. 7 depicts a lens 701 having conductive fibers (not shown), collectively oriented along diagonal arrows 702 and 703, and in some embodiments layered as in FIG. 6. This is an example of an anisotropic lens that can be applied to a cross-polarized polarized element, which would permit changing beamwidth without changing polarization.

Figure 8:
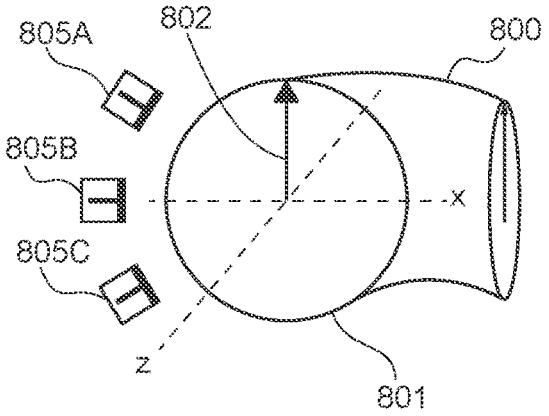
FIG. 8 is a schematic of an anisotropic torus shaped lens positioned in front of multiple single-polarized radiating elements.

FIG. 8 depicts a lens assembly 800 that includes torus lens 801, which has DK in the Y direction 802, applied in front of multiple single-polarized radiating elements (not shown) all polarized in the Y direction. When the lens 801 is rotated around the Z axis, the resultant beamwidth (not shown) from all elements is adjusted.

It is contemplated that lens 801 could be moved along horizontal and/or vertical planes to vary the resultant polarization. Anisotropic lenses with different shapes can be applied to variably adjust resultant polarization for single and dual-polarized elements and antennas. Similar principals can be applied to multi-beam antennas.

Figure 9:
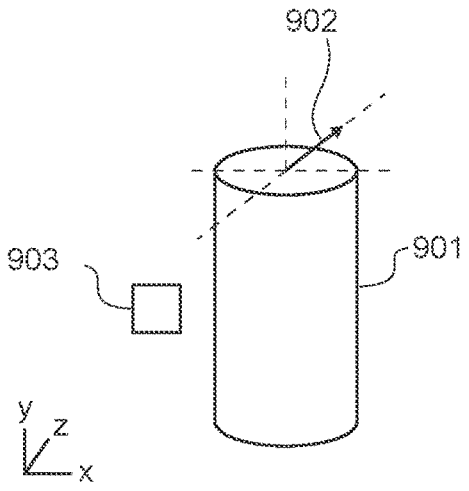
FIG. 9 is a schematic of a curved cylinder anisotropic lens positioned in front of a single radiating element or antenna.

FIG. 9 depicts a single cylindrical anisotropic lens 901, which has DK in the direction of arrow 902, positioned in front of a single radiating element or antenna 903. Mechanical or electronic rotation of lens 901 about the Y axis adjusts the beamwidth or other characteristics of the resulting beam (not shown). Lens 901 could, for example, have a single orientation magnitude of DK 3.

Figure 10:
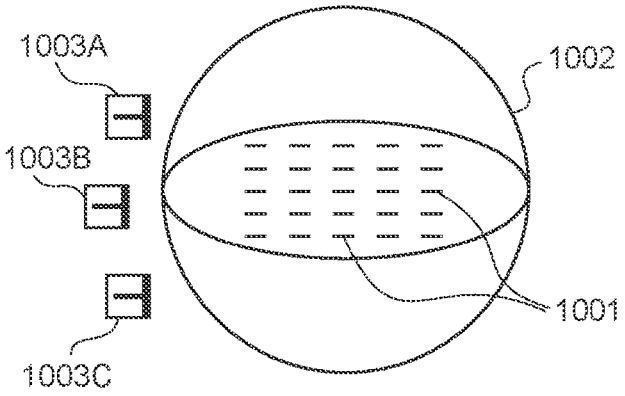
FIG. 10 is a schematic of a spherical anisotropic lens 1002 positioned in front of multiple radiating elements or antennas.

FIG. 10 depicts a spherical anisotropic lens 1002 positioned in front of multiple radiating elements or antennas 1003A, 1003B, 1003C. Lens 1002 had conductive fibers 1001 oriented as shown. Rotation or other movement of lens 1002 concurrently adjusts the beamwidth or other characteristics of the resulting beam(s) (not shown).

Figure 11:
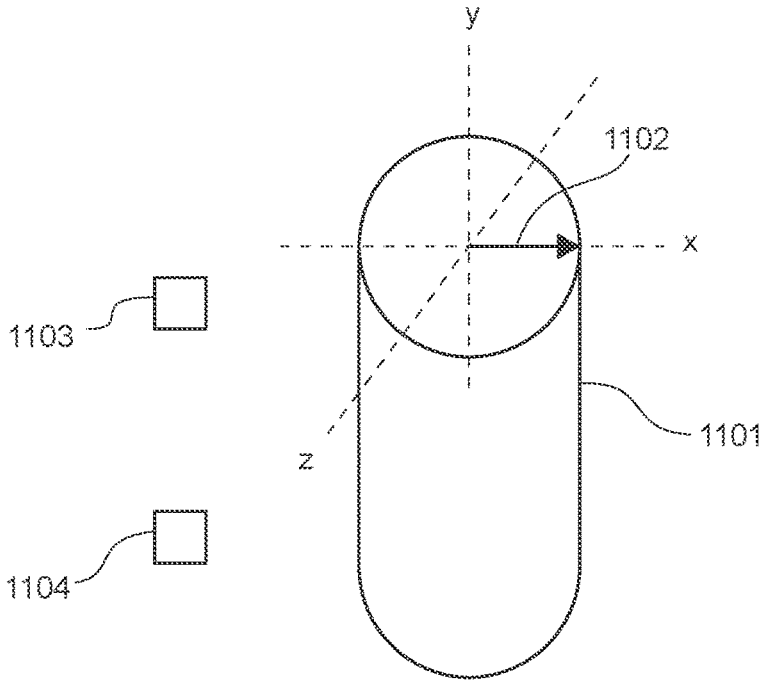
FIG. 11 is a schematic of a curved cylinder anisotropic lens positioned in front of multiple radiating elements or antennas.

FIG. 11 is similar to FIG. 9, except that in this example, a single curved cylinder anisotropic lens 1101, which has DK in the direction of arrow 1102, is positioned in front of multiple radiating elements or antennas 1103, 1104. Mechanical or electronic rotation of lens 1101 about the Y axis adjusts the beamwidth or other characteristics of the resulting beam(s) (not shown).

As should be apparent from the examples herein, individual anisotropic lenses of different shapes and combinations can be placed in front of single antenna elements, as well as multiple element antennas and radiating elements to satisfy specific requirements. Among other things, one or more anisotropic lenses can be used to simultaneously, or independently, adjust the resulting horizontal and vertical beamwidths, and/or other beam characteristics.

Figure 12:
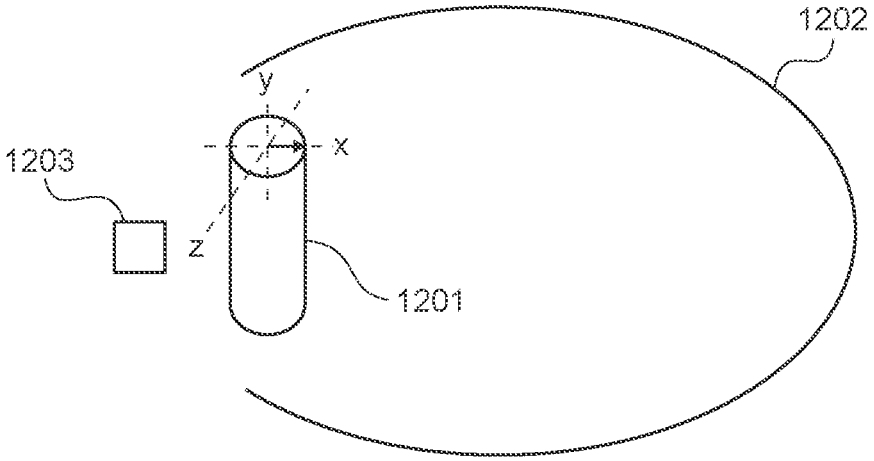
FIG. 12 is a schematic of an anisotropic cylindrical lens physically oriented in the Y axis, with DK oriented in the X axis. The lens is positioned in front of a single element.

In particular, cylindrical or disc shaped anisotropic lenses can be used to variably adjust resultant horizontal or vertical beamwidth. FIG. 12 depicts an anisotropic cylindrical lens 1201, physically oriented in the Y axis, with DK oriented in the X axis. Lens 1201 is applied (positioned in front of) radiating element 1203 with linear polarization along the z direction. Due to the shape of lens 1201 and its orientation, rotation of the lens 1201 about the Y axis narrows the vertical beam 1202 but has no effect on the horizontal beam.

Figure 13:
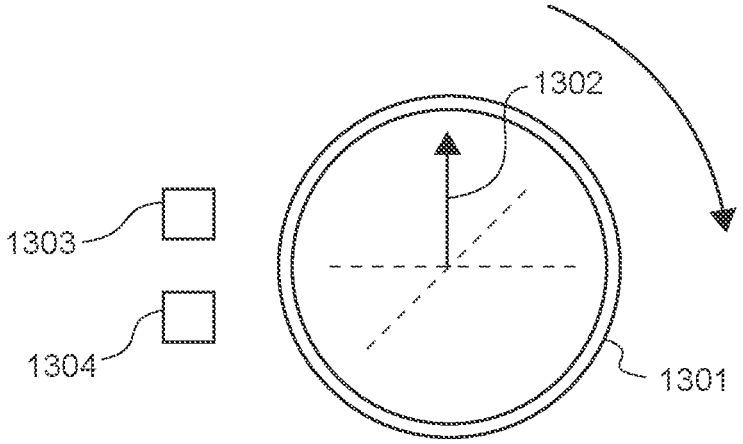
FIG. 13 is a schematic of a disc shaped anisotropic lens applied to multiple radiating elements

Other shaped lenses with different DK orientations can be used depending on application. For example, FIG. 13 depicts a disc shaped anisotropic lens 1301 applied to radiating elements 1303, 1304. Lens 1301 is anisotropic with respect to arrow 1302, and can be rotated on different axes in order to adjust resultant vertical or horizontal beamwidth.

Anisotropic lenses can also be applied to a variety of antennas including radar, BSA, satellite and others. For example, anisotropic lenses can be applied to standard phased array antennas (BSA antennas typically used in telecommunications). Individual lenses can be applied to each individual radiating element of the phased array antenna, and all of the lenses can then be mechanically or electronically turned or rotated simultaneously or individually as needed in order to adjust resultant parameters of the antenna.

Figure 14:
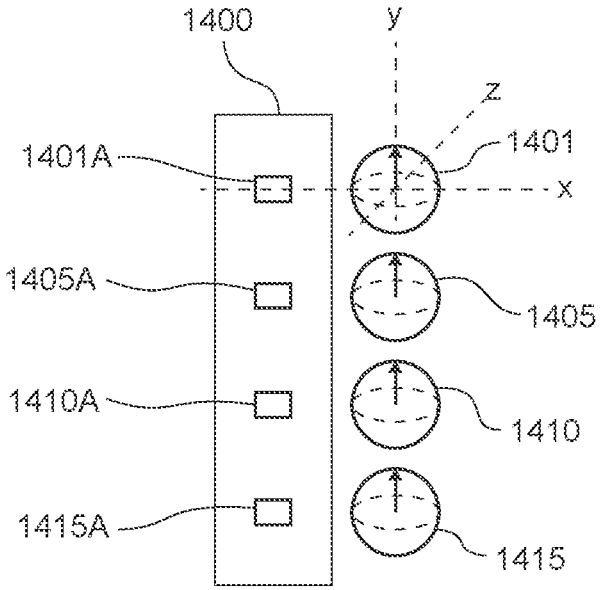
FIG. 14 is a schematic of multiple spherical anisotropic lenses positioned in front of a phased array antenna. The multiple lenses are moved simultaneously.

FIG. 14 depicts a phased array antenna 1400 that includes multiple radiating elements 1401A, 1405A, 1410A, and 1415A, in front of which are positioned multiple spherical anisotropic lenses 1401, 1405, 1410, 1415, each with its DK oriented in the Y direction. Lenses 1401, 1405, 1410, 1415 can be simultaneously rotated around the Z axis in order to adjust the resultant beamwidth (not shown) of the antenna 1400.

Figure 15:
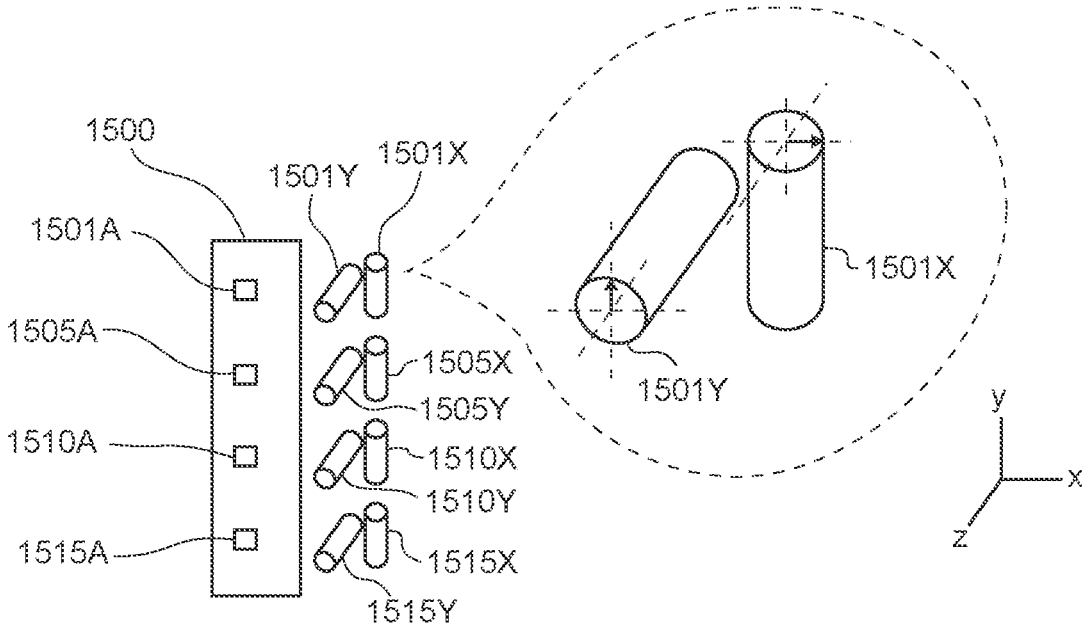
FIG. 15 is a schematic of multiple small cylindrical anisotropic lenses positioned in front each element of a phased array antenna. One or more the multiple lenses can be moved simultaneously.

FIG. 15 depicts a phased array antenna 1500 that includes multiple radiating elements 1501, 1505, 1510, 1515, in front of which are positioned multiple cylindrical anisotropic lenses, one with its DK oriented in the X direction 1501X, 1505X, 1510X, 1515X, and another in the Y direction 1501Y, 1505Y, 1510Y, 1515Y. The lenses can be rotated along their long axes in order to adjust the resultant beamwidth, rotation of the 1501Y, 1505Y, 1510Y, 1515Y lenses to adjust horizontal beam width, and rotation of the 1501X, 1505X, 1510X, 1515X lenses to adjust the vertical beamwidth (not shown).

It is also contemplated to use a single or multiple cylindrical anisotropic lenses (not shown) which are sized and dimensioned to receive beams from all elements of a phased array antenna.

Figure 16:
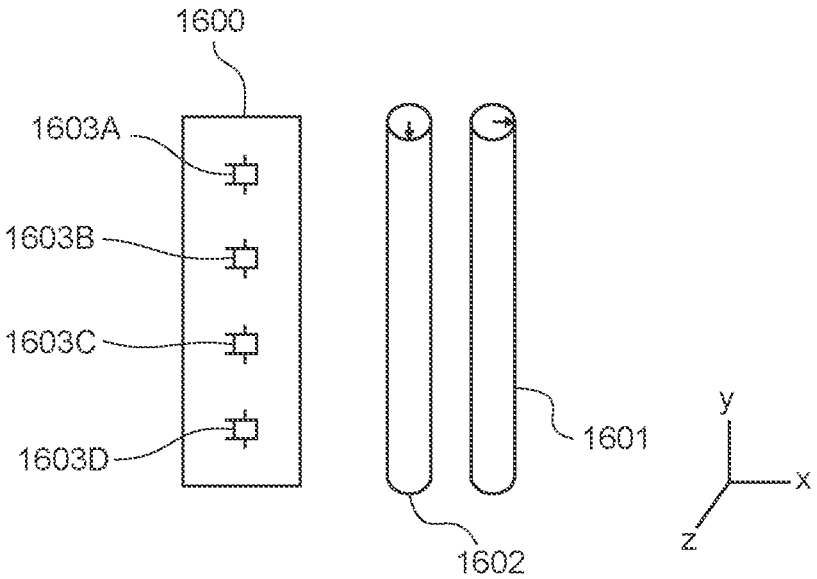
FIG. 16 is a schematic of two large cylindrical anisotropic lenses positioned in front of a phased array antenna, where the lenses can be moved simultaneously.

FIG. 16 depicts two coplanar, anisotropic cylindrical lenses 1601, 1602 placed in front of a phased array antenna 1600 with elements 1603A, 1603B, 1603C, and 1603D, oriented in the Y axis. The lenses 1601, 1602 have their DK oriented in the X or Z axes. As the lenses 1601, 1602 are rotated (either mechanically or electronically) the resultant beam direction is changed. Use of multiple cylinders allows resulting beams to be steered more precisely.

Figure 17:
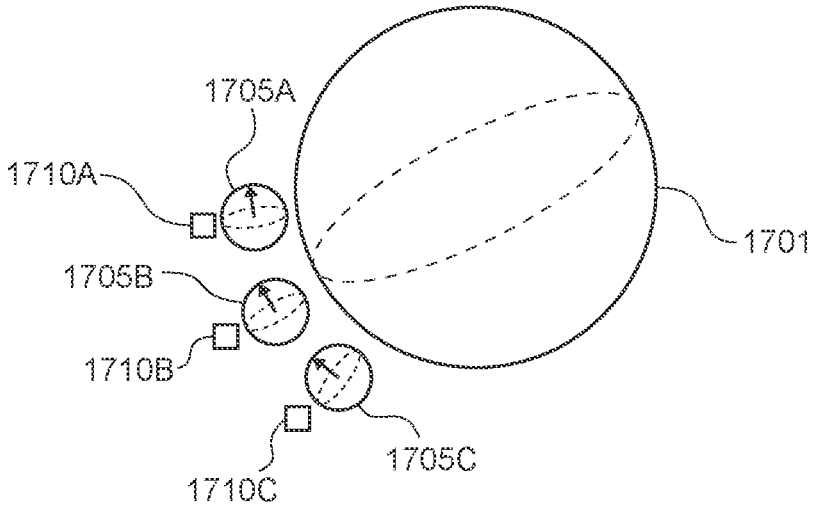
FIG. 17 is a schematic of a large isotropic lens positioned in front of multiple smaller anisotropic lenses, which are positioned in front of multiple radiating elements arranged vertically around the large isotropic lens.

It is also contemplated that a large isotropic lens can be used in conjunction with multiple, smaller anisotropic lenses to adjust resultant RF parameters of an antenna. FIG. 17 depicts a large spherical isotropic lens 1701 positioned in front of multiple smaller anisotropic lenses 1705A, 1705B, 1705C, which are positioned in front of radiating elements 1710A, 1710B, 1710C, respectively a multibeam antenna.

Figure 18:
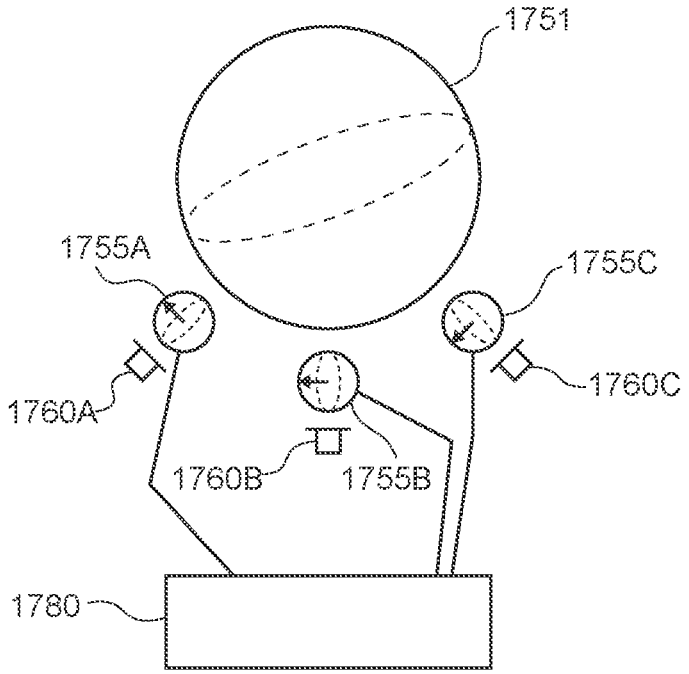
FIG. 18 is a schematic of a large isotropic lens positioned in front of multiple smaller anisotropic lenses, which are positioned in front of multiple radiating elements arranged horizontally around the large isotropic lens.

FIG. 18 depicts a configuration similar to that of FIG. 17, which includes a large isotropic lens 1751 used in conjunction with multiple, smaller anisotropic lenses 1755A, 1755B, 1755C and radiating elements 1760A, 1760B, 1760C. Here, a controller 1780 is configured to independently or simultaneously rotate lenses 1755A, 1755B, 1755C to adjust resultant beam parameters of an antenna.

In FIGS. 19-22, a reconfigurable Luneburg lens 1901 (which can be spherical, cylindrical, or planar) uses at least one liquid dielectric liquid with a high dielectric constant. Differing amounts of the liquid can be inserted into the lens using micro-pipes, and resulting lenses can have different distributions of DK to form beams with different beamwidths/shapes. Another, more traditional way to move the liquids into the lens is using of pumps, or micropumps, such as the Bartels micropumps available from Mikrotechnik (see http://www.bartels-mikrotechnik.de/content/view/9/15/lang.english/. Both electronic (electrowetting) or mechanical (with pumps) control methods can be used to transfer the dielectric liquid(s), and both are PIM-free.

Pipes can have uniform distribution inside the lens (to achieve quasi-homogeneous lens with resulting DK 1.6-2.3) or can have increased concentration to the center $\varepsilon=2-(r/R)^2$ for multi-layer Luneburg Lens (R is radius of the lens). The center might or might not be filled with a dielectric liquid. Table 1 below show examples of these dielectrics with DK from about 20 to about 200. All liquids shown in Table 1 are electrostatically movable, i.e. can be moved (into lens or out of lens) by application of static electrical field (so called electrowetting). Also, all of them has low PIM (passive intermodulation) which is beneficial for wireless communications applications, as 4G/LTE.

TABLE 1

| Liquid | Dielectric Constant | Density (g/cm3) | Viscosity (mPa * s) | Melting Point (C.) | Boiling Point (C.) |
|---|---|---|---|---|---|
| Propylene Carbonate | 65 | 1.198 | 25 | −55 | 240 |
| y-butyrolactone | 42 | 1.13 | 1.7 | −43 | 204 |
| DMSO | 41 | 1.1 | 1.996 | 19 | 189 |
| Propionitrile | 28 | 0.772 | | −93 | 97 |
| 2-propanol | 18 | 0.785 | | −90 | 82 |
| N-methylacetamide | 179 | 0.957 | | 27 | 205 |
| Acetonitrile | 38 | 0.7857 | 0.316 | −45 | 82 |
| Ethanol | 24 | 0.789 | | −114 | 78 |
| Propylene Glycol | 32 | 1.04 | 48.6 | −60 | 188 |
| N-methylformamide | 171 | 1.011 | | −4 | 199 |
| Methanol | 30 | 0.791 | | −98 | 65 |
| Ethylene Glycol | 37 | 1.1132 | 16.1 | −13 | 197 |
| Glycerol | 43 | 1.25 | | 20 | 182 |
| Hydroxy Propylene Carbonate | 110 | 1.4 | | −69 | |
| Formamide | 109 | 1.133 | 3.75 | 3 | 211 |

Figure 19:
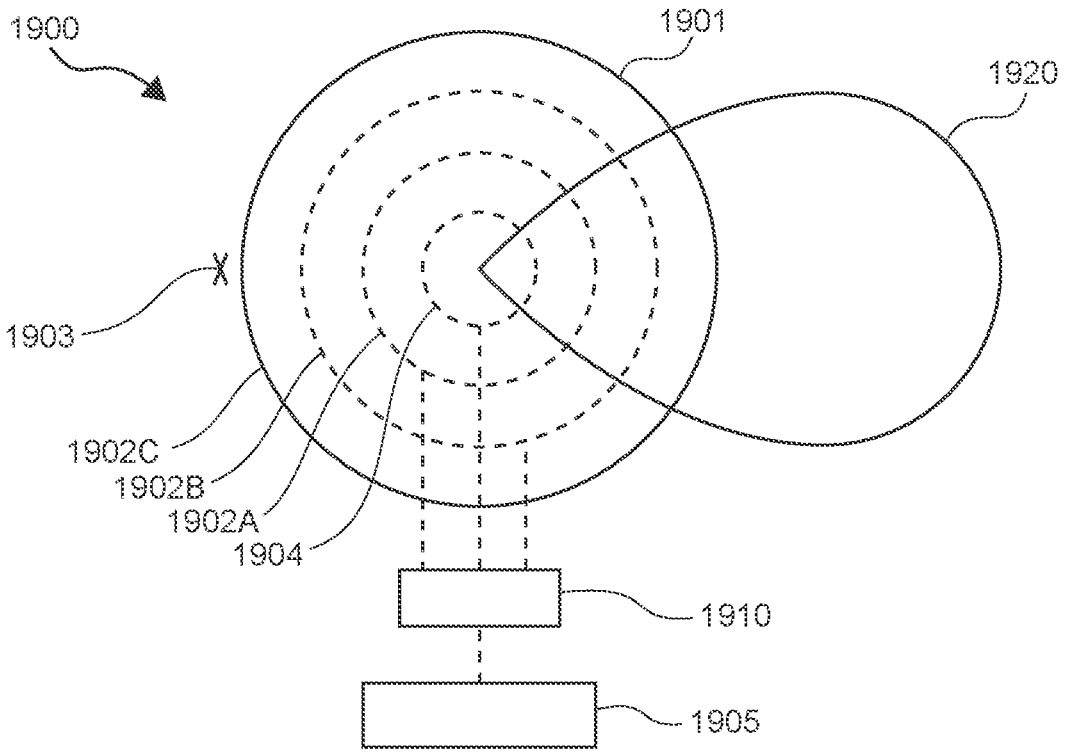
FIG. 19 is a schematic of a reconfigurable antenna having a lens with multiple concentric plastic pipes that are empty.

FIG. 19 depicts a reconfigurable antenna 1900 having a lens 1901 comprising multiple concentric plastic pipes 1902A, 1902B, 1902C positioned about central core 1904, a reservoir 1905, pumps 1910, and a radiator 1903. All of a dielectric liquid is in the reservoir 1905, and the pipes are delineated with dotted lines. The lens 1901 is homogeneous with low DK (1.1-1.2) and low focusing ability, so the radiation pattern has a wide beam 1920. The core 1904 can include the dielectric liquid or another dielectric material.

Figure 20:
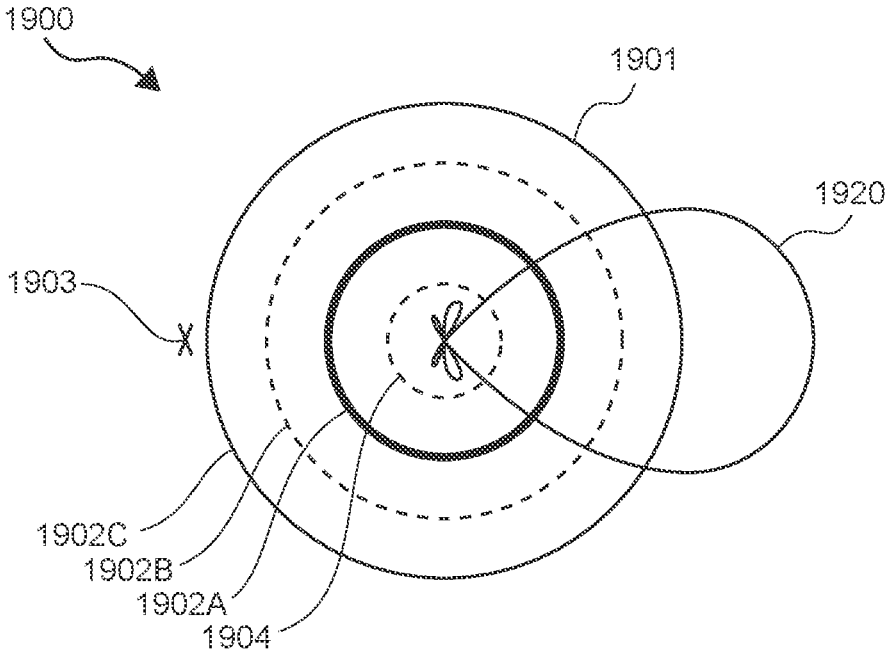
FIG. 20 is a schematic of the reconfigurable antenna of FIG. 19, in which some of the concentric plastic pipes are filled with a dielectric liquid.

In FIG. 20 the pipes 1902A and 1902B of lens 1901 contain a dielectric liquid (shown with solid line) that was pumped in from the reservoir (shown only in FIG. 19). The resulting (average) DK inside lens 1901 is higher, and the beamwidth is narrower. In FIG. 20-23, pumps 1910 and reservoir 1905 (or electronic circuits in the case of electrowetting) are not shown for simplicity.

Figure 21:
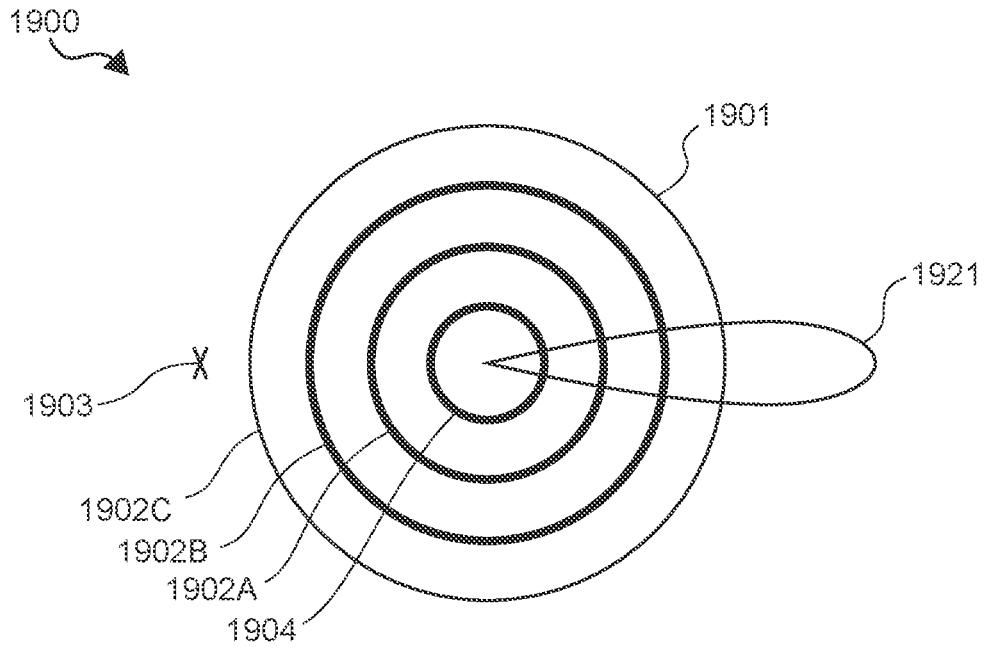
FIG. 21 is a schematic of the reconfigurable antenna of FIG. 19, in which all of the concentric plastic pipes are filled with a dielectric liquid.

In FIG. 21 all of the pipes 1902A, 1902B, 1902C are filled with the dielectric liquid. The resulting DK inside the lens 1901 is higher, and its distribution is approximately the same as required for a multi-layer Luneburg Lens: $\varepsilon=2-(r/R)^2$, resulting in a narrow beam 1921 with low sidelobes. 3 dB beamwidth in this case is approximately equal 30λ/R [deg].

Figure 22:
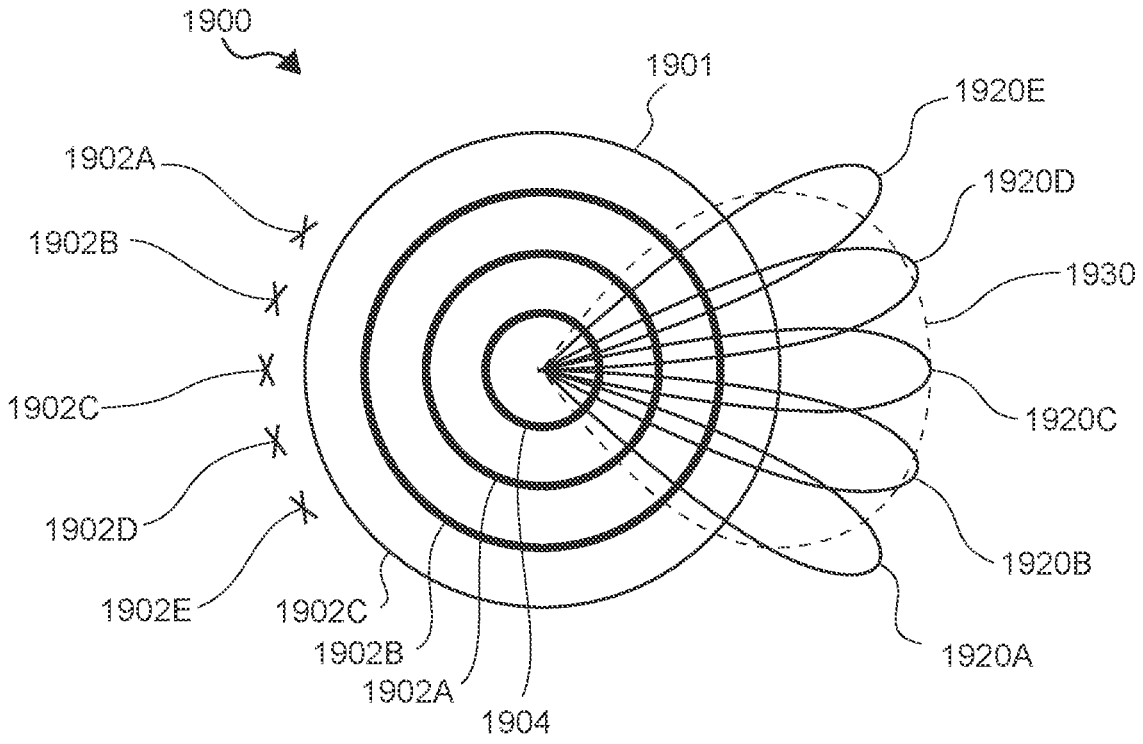
FIG. 22 is a schematic of the reconfigurable antenna of FIG. 19, in which all of the concentric plastic pipes are filled with a dielectric liquid, and further including five radiators.

In FIG. 22 all of the pipes 1902A, 1902B, 1902C are filled with the dielectric liquid. Antenna 1900 has five radiators 1903A, 1903B, 1903C, 1903D, and 1903E, which emit electromagnetic waves that are beam formed through lens 1901 to produce 5 narrow dual-polarized beams 1920A, 1920B, 1920C, 1920D, and 1920E, respectively. This provides high capacity coverage 1930. For comparison, one wide beam 1930, which would be formed by the central element with none of the pipes activated by being filled with the dielectric liquid, has a relatively lower low capacity coverage for the same geographic area.

Antenna 1900 of FIG. 22 could advantageously be used for wireless/cellular communications, in which the antenna can cover the same geographic area with one wide beam (low traffic/low capacity) or with multiple beams (higher traffic/higher capacity). Accordingly, adaptive beamforming can be achieved which is especially desirable for 5G applications. Single or dual polarized radiators could be used in any of the embodiments of FIGS. 19-22).

It is also contemplated, that asymmetrical micro-pipes activations and other adaptive beamforming methods could also be used, including null forming in the direction of interference.

In other contemplated embodiments, micro-pipes can be used instead of wires/conductive fibers for antenna solutions similar to configurations shown in FIG. 5-FIG. 7.

Figure 23:
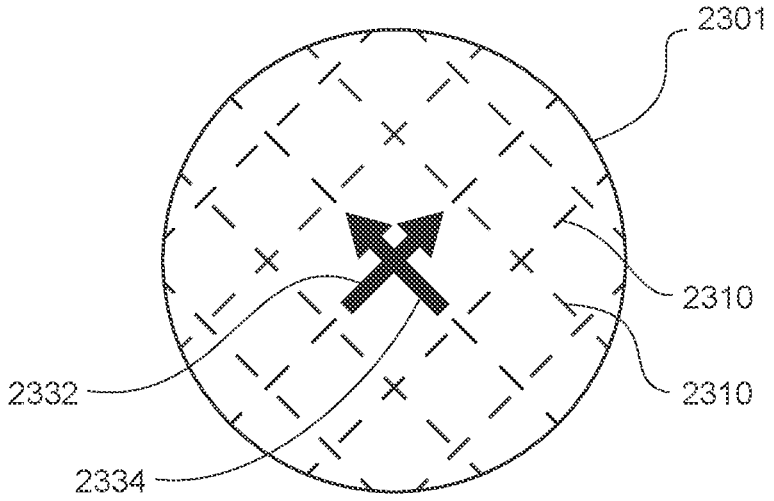
FIG. 23 is a cross-section of a spherical, reconfigurable, dual-polarized lens with empty pipes.
Figure 24:
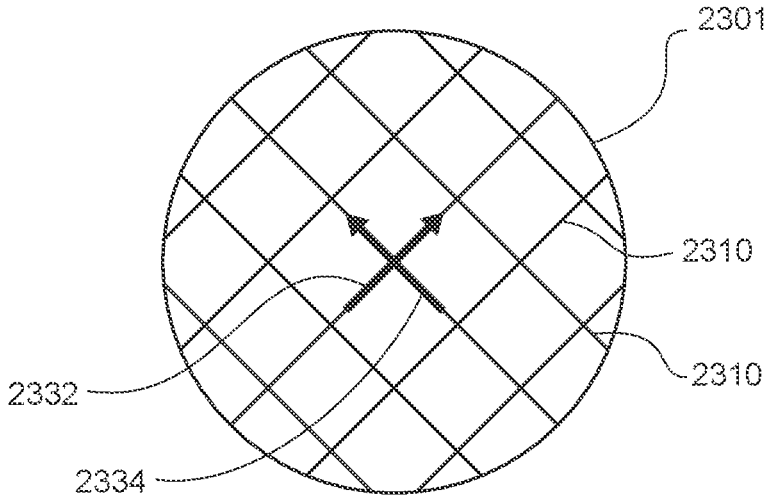
FIG. 24 is a horizontal cross-section of a spherical, reconfigurable, dual-polarized lens with full pipes.

FIG. 23 is a horizontal cross-section of a spherical, reconfigurable, dual-polarized lens 2301. Empty pipes are depicted by dotted lines 2310, provide relatively weak polarization along arrows 2332, 2334, and result in formation of a relatively wide beam. In FIG. 24, the pipes are filled with a dielectric liquid, depicted by solid lines 2312, and provide relatively weak polarization along arrows 2332, 2334, which results in formation of a relatively narrow beam.

Figure 25:
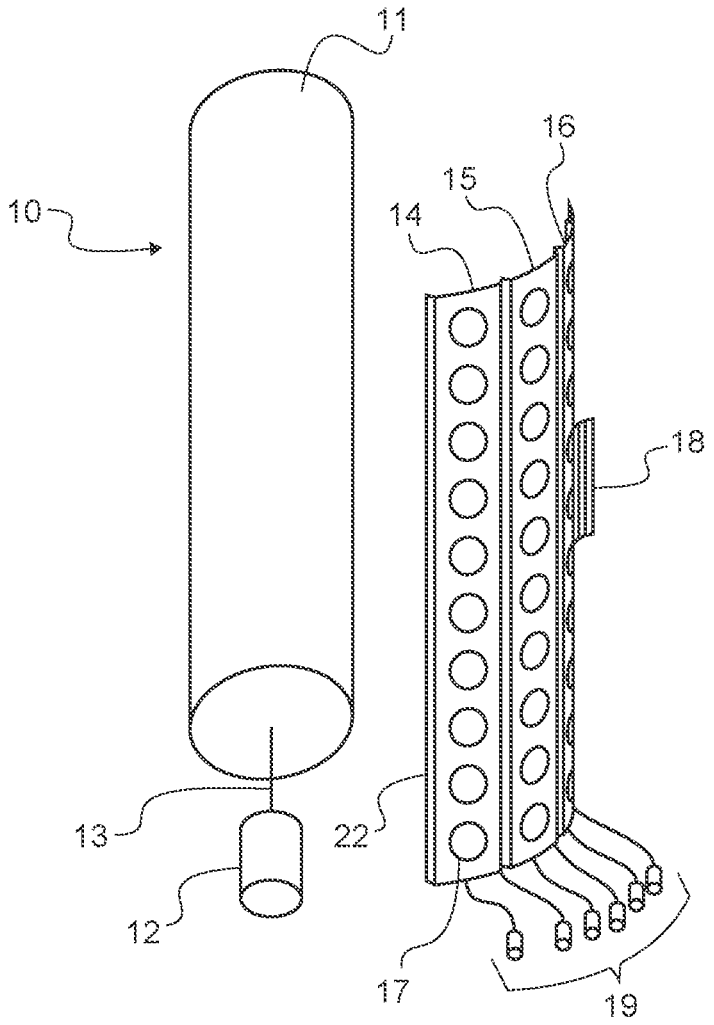
FIG. 25 is a schematic of a reconfigurable base station antenna having a motorized anisotropic lens positioned in front of a base station antenna.

In FIG. 25 a reconfigurable base station antenna 10 includes an anisotropic cylindrical lens 11 with motor 12, making available rotation lens 11 about its axis of rotation 13. Antenna 10 also contains three vertical columns (linear arrays) 14, 15, 16 of radiators 17 which have linear slant +/−45° polarization. Radiators 17 are connected through phase shifters 18 to input connectors 19 (total 6 connectors). Phase shifters 18 are used beam tilting of each of columns 14, 15, 16 and placed on the rear side of reflector 21.

Figure 26A:
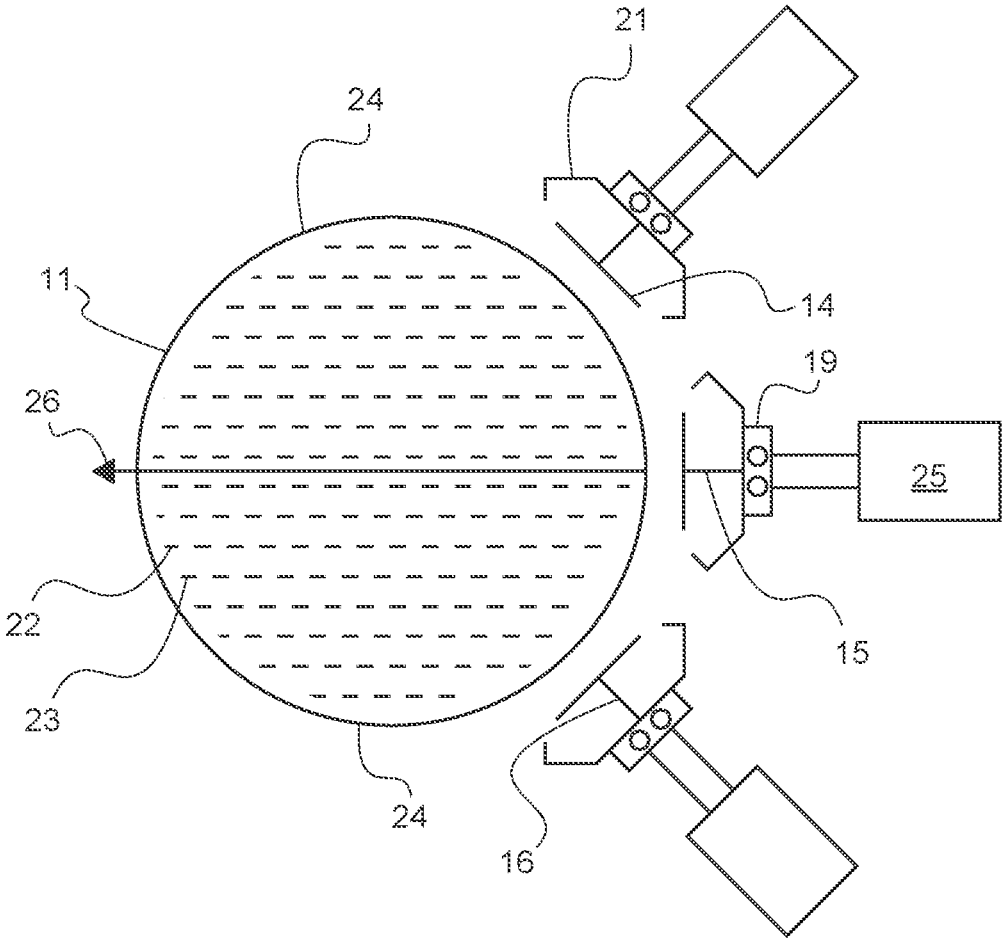
FIG. 26A is a horizontal cross-sectional view of the reconfigurable base station antenna of FIG. 25.

FIG. 26A is a horizontal cross-sectional view of the reconfigurable base station antenna of FIG. 25. Conductive fibers 22 with length 0.02~0.1λ are depicted inside lens 11, all oriented in 0° direction. For wideband operation, conductive fibers 22 can have different length. To support wires 22, light weight foam polymer 23 is used with low dielectric constant (close to 1.0). Matching layer 24 (optional) provides reduction of reflection from lens 11 when it is rotated to position close to 90°. Radio 25 is connected to central column 15, other columns 14, 16 are not connected. Arrow 26 shows direction of radiation.

Figure 26B:
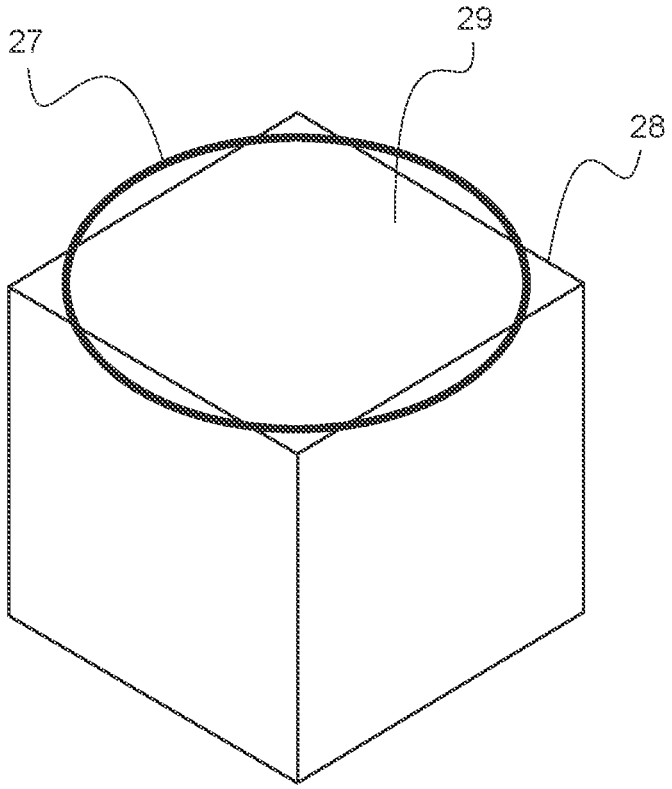
FIG. 26B is a diagram showing a single beam pattern relative to a sectored cell.

With lens position shown in FIG. 26A, in direction of radiation 26, lens has dielectric constant close to 1, because wires 22 are orthogonal to vector E of column 15. Lens does not focus EM waves from column 15. Column 15 has wide azimuthal beam 27 (FIG. 26B), covering 120° sector in three sectored cell site (as shown in FIG. 26B, where 28 is hexagonal cell). In FIG. 26B, cell 28 sectorization is shown for a 3-sectored cell.

In FIG. 26B, 10 dB azimuth beam 27 has 10 dB azimuth width of about 120°. With lens 11 rotation from 0° to 90°, 10 dB azimuth beamwidth can be gradually adjusted from about 120° to about 40° and antenna gain is increased by 5 dB.

Figure 27A:
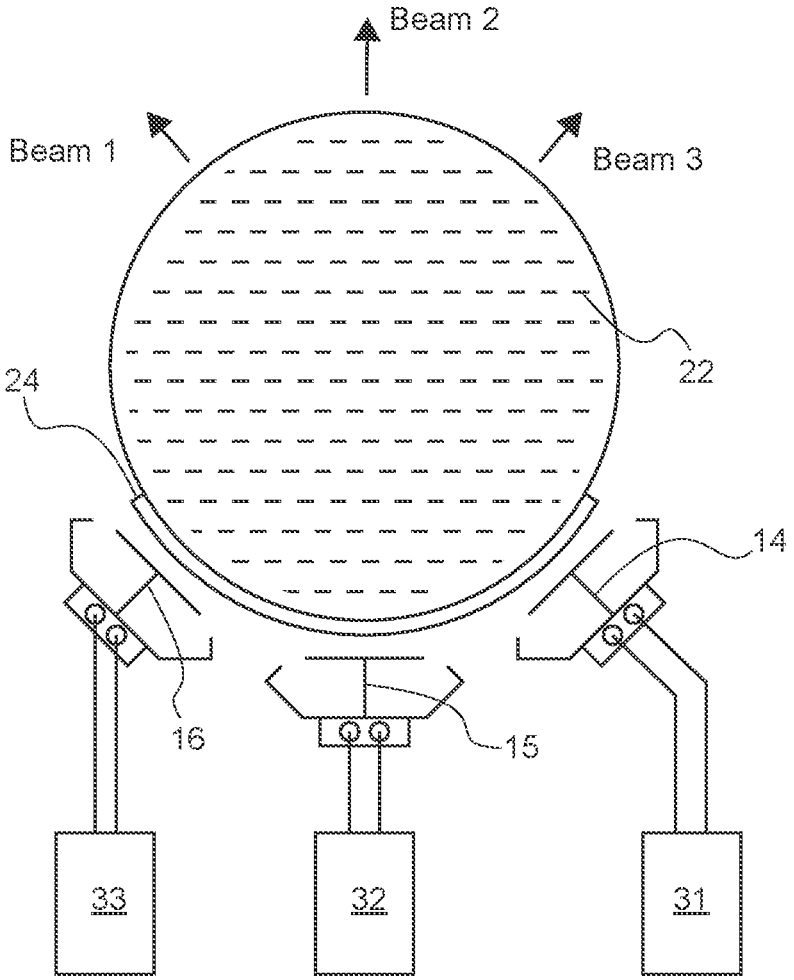
FIG. 27A is a schematic of a reconfigurable base station antenna of FIG. 26A, with the lens rotated 90°.

In FIG. 27A, lens 11 is rotated to 90° position, and in this position, wires 22 are mostly parallel to vectors E of all three columns, and lens 11 does focus EM waves from columns 14, 15, 16, resulting in three narrower beams. Three radios 31, 32, 33 cover 120° sector 28 of hexagonal cell 27 with 3 times increased capacity compare to FIG. 26B.

Figure 27B:
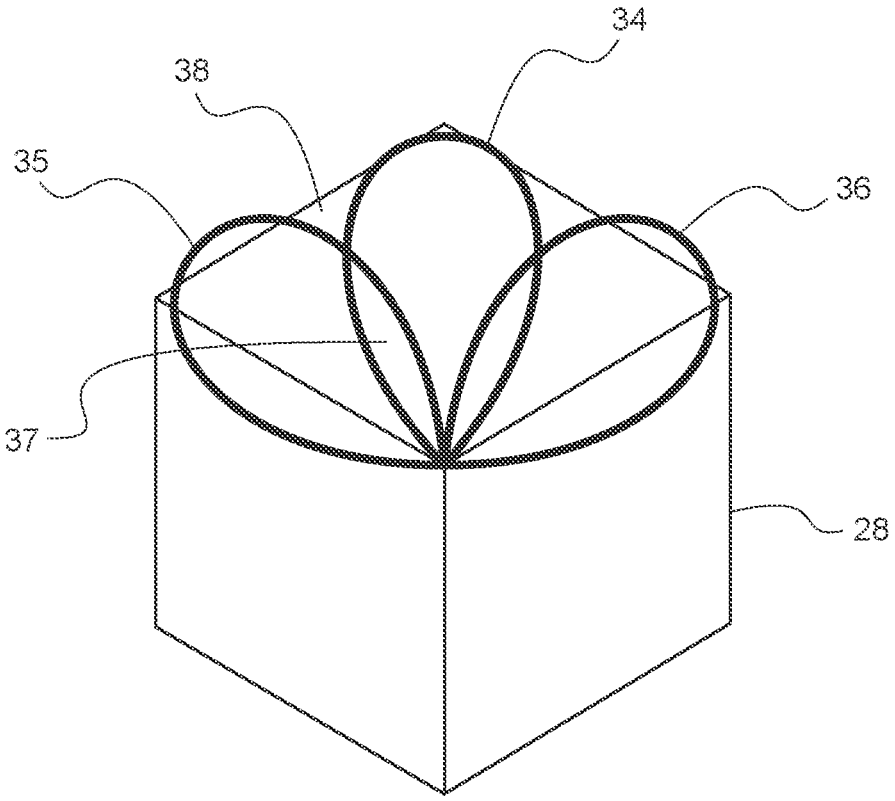
FIG. 27B is a diagram showing a three beam pattern relative to a sectored cell.

As shown in FIG. 27B, the three 3-beam base station antenna of FIG. 27A delivers three beams to a 120° sector. Central beam 34 is symmetrical and little bit narrower compare to outer beams 35, 36 which are slightly asymmetrical. Together, beams 34,35, 36 deliver coverage of cell sector 28 close to optimal, with minimal interlace 37 and gaps 38.

Polarization diversity/MIMO performance does suffer with rotation of cylinder 11 from 0 to 90°, because orthogonal polarization is maintained, from +/−45 orthogonal linear to R-L circular polarization. With R-L circular polarization, MIMO performance can be improved because circular polarization provides better in-building penetration, which is especially important for high (5G) frequencies.

With rotation of cylinder 11, antenna vertical pattern stays practically unchanged (the same beam tilt, the same elevation beamwidth). Equally, azimuth beamwidth also does not change with elevation beam tilt, even with heavy tilts (30°+). This helps to manage the same geographic coverage when antenna is reconfigured from one wide beam to three narrow beams.

Figure 28A:
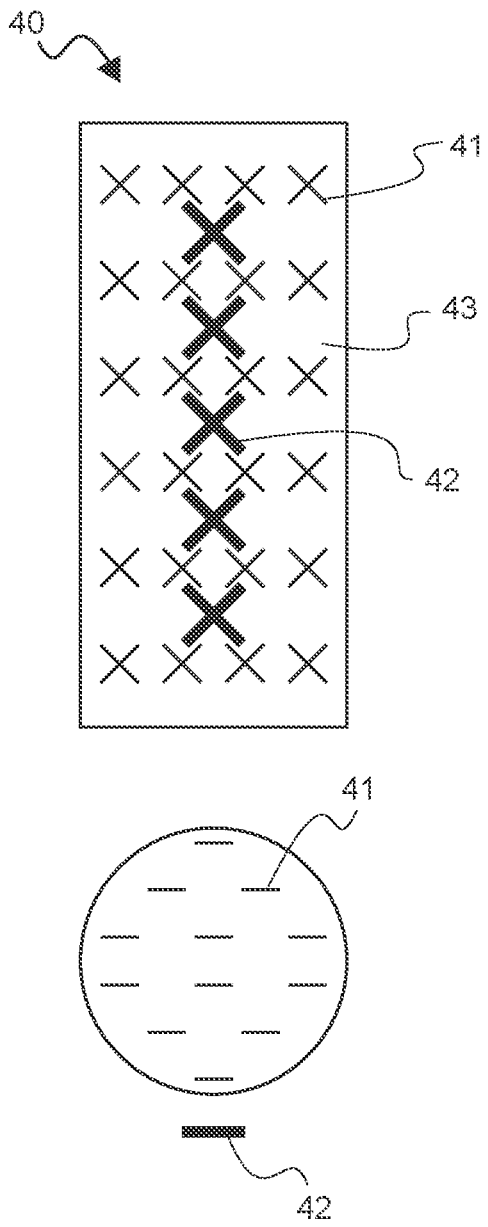
FIGS. 28A-28C are schematics of vertical and horizontal cross-sections of different rotations of an anisotropic cylindrical lens.
Figure 28B:
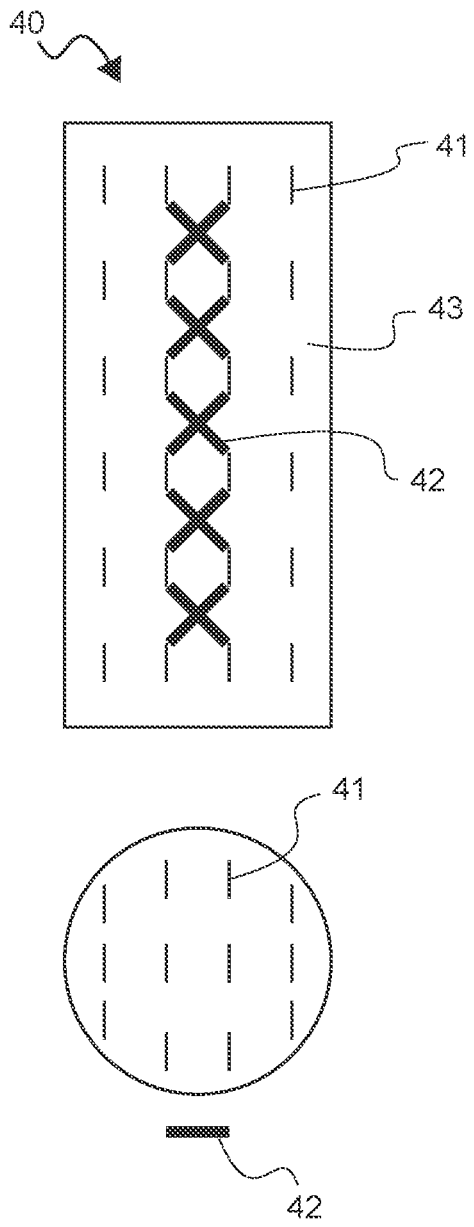
Figure 28C:
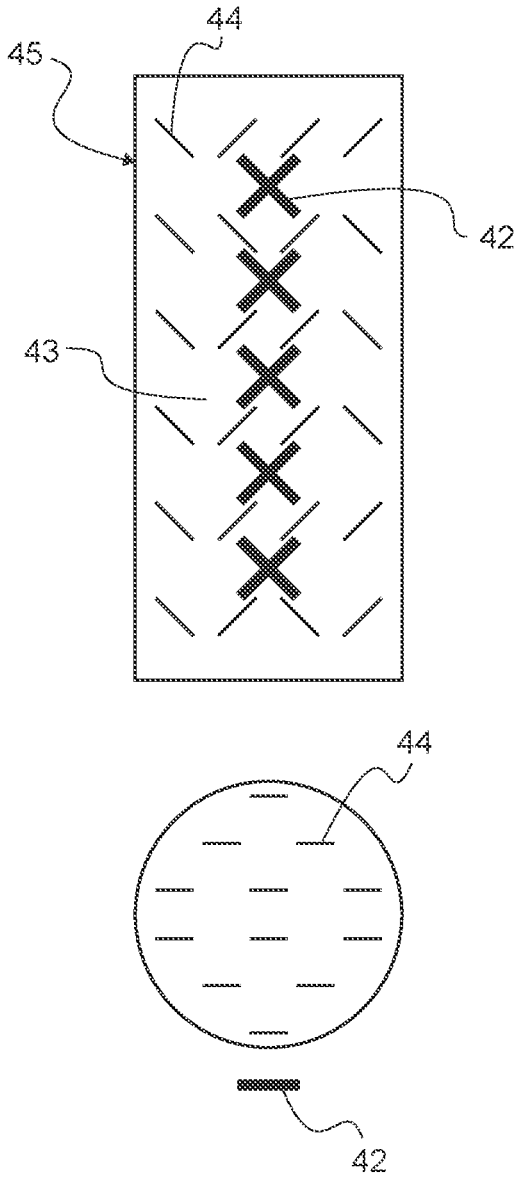

FIGS. 28A-28C depict another embodiment in which a different kind of artificial anisotropic dielectric is used. Antenna assembly is the same as in FIG. 25, but cylindrical lens 40 is different and it has 2 functions: 1) focusing the beam in the azimuth plane; 2) works as a polarizer. With rotation of cylinder 40, azimuth beamwidth stays the same, but antenna polarization is changed from +/−45° (rotation angle is 0°) to circular (LHCP+RHCP, rotation angle is)+/−90°. Conductive fiber particles in cylinder 40 have shape of crosses with +/−45° orientation to horizon, with the length of arms 0.02~0.1λ., and these crosses are parallel to each other, as shown in FIG. 28*a*, 28*b*. Radiation elements of antenna (+/−45° polarized) are schematically shown as big crosses 42, and one column of elements is shown for simplicity. In FIG. 28*a*, rotation angle 0° is shown. Resulting polarization of antenna is linear slant +/−45° in this case, because direction of cross arms 41 coincide with +/−45° linear polarization of elements 42. In FIG. 28*b*, rotation angle 90° is shown. Resulting polarization of antenna is circular (LHCP+RHCP, or R-L basis) in this case, because vertical component of vector E has 90° phase shift compare to its horizontal component. This phase shift is controlled by concentration of crosses 41 in the lens 40. In addition to crosses 41, lens 40 can be also filled with isotropic dielectric 43 (for example, with artificial dielectric by U.S. Pat. No. 8,518,537) to provide required azimuth beamwidth. Antenna azimuth beamwidth is not changed with rotation, because projections of vector E on crossed arms stay the same, invariant to rotation of lens 40. Note, that with others angles of rotation, two orthogonal elliptical polarizations are provided, with axial ratio from 0 to 1.

Depending on the MIMO environment, different orthogonal polarization basis (linear, elliptical or circular) can be selected to improve MIMO performance. Antenna with 2 circular polarizations (LHCP+RHCP) have benefits compare to linear polarization, as reported in Analysis of MIMO Diversity Improvement Using Circular Polarized Antenna J.

W. Zhaobiao and Xinzhong Li. International Journal of Antennas and Propagation/2014 https://www.hindawi.com/journals/ijap/2014/570923/.

Not only crosses (as shown in FIG. 28A, 28B), but others shapes of conductive particles can be used in anisotropic lenses for polarization agility, including, for example, conductive rings (circular, square, diamond) and discs. In some embodiments, separated slant conductive fibers 44, oriented orthogonally, can be used in lens 45, as shown in FIG. 28C.

Figure 29A:
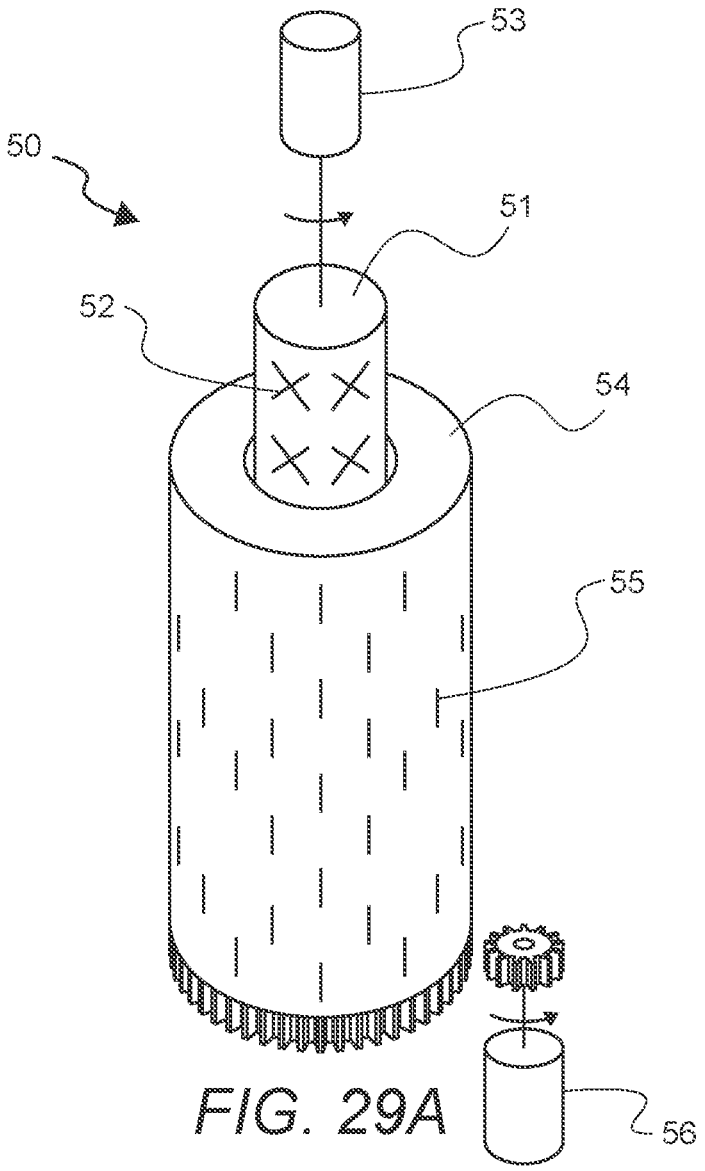
FIG. 29A is a partially exploded isometric view of another anisotropic cylindrical lens, which can provide both antenna pattern and polarization reconfigurability.
Figure 29B:
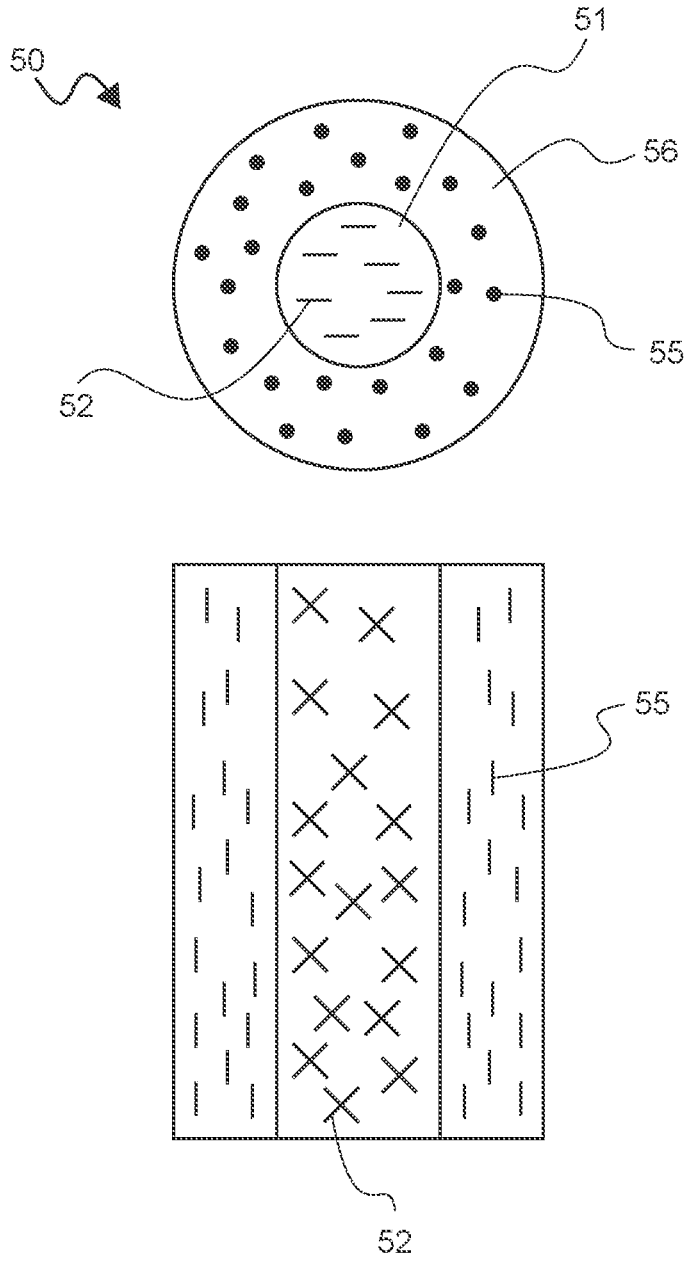
FIG. 29B shows horizontal and vertical cross-sections of the anisotropic cylindrical lens of FIG. 29A.

In FIGS. 29A, 29B, another anisotropic cylindrical lens 50 is shown which can provide both antenna pattern and polarization reconfigurability, and it contains two coaxial cylinders. Inner cylinder 51 with crosses 52 is responsible for polarization agility, and it is rotated by motor 53. Hollow cylinder 54 with vertical fibers 55 is responsible for pattern agility, and it is rotated by motor 56. Antenna assembly (not shown) is similar to presented in FIG. 25, but the lens in FIGS. 29A and 29B is different, and two motors are used instead of the one in FIG. 25). In FIG. 29A, an exploded isometric view is schematically shown. In FIG. 29B, cross-sectional (horizontal and vertical) views of anisotropic lens 50 are shown. In this embodiment, antenna reconfigurability is obtained by moving (rotation) of two anisotropic bodies.

Performance of cylindrical lens 55 is similar to described above (FIGS. 26A, 26B, 27A, 27B): with rotation of lens 55 by motor 56, azimuth beam width can be changed and number of beams can be changed. With rotation of lens 51 by motor 53, orthogonal polarization basis of the antenna can be changed from linear +/−45° to circular R-L (similar as was described above for FIGS. 28A, 28B.

Antenna shown in FIGS. 29A, 29B has several degrees of freedom:

- Polarization agility (two orthogonal polarization with axial ratio vary from 0 to 1);
- Azimuth pattern reconfigurability;
- Number of beams selection (reconfiguration from one beam to multi-beam);
- Beam steering (tilting) in elevation plane;
- Gain reconfigurability In embodiments of 25-29A, 29B, there may be more or fewer than three columns of radiating elements.

Instead of conductive (metal) particles, other material(s) can be used to build anisotropic materials, including non-conductive fibers with high dielectric constant, oriented mostly in one (or two orthogonal) directions.

In another embodiment, parallel carbon fibers can be used for antenna gain adjustment without changing antenna pattern. When carbon fibers are oriented orthogonal to vector E, antenna gain is maximal and when they are oriented parallel to vector E, antenna gain is minimal.

Particles can be distributed uniformly in dielectric body (can be low density foam) to form homogeneous lens, or can have more concentration in central area to help wideband matching. Special distribution of density (for example, Luneburg) is also possible.

Performance of the cylindrically shaped anisotropic dielectric bodies described should be interpreted generically to illustrate proposed apparatus and methods. Other shapes of anisotropic dielectric body (as spherical, truncated spherical, hemispherical, spheroidal) can be used for different applications. Arrays of spherical and/or cylindrical anisotropic dielectric bodies can also be used.

Materials

Anisotropic dielectric and magnetic lenses discussed herein can be made using fibers, flakes, discs or other materials having magnetic properties, provided the resulting lenses can be oriented to produce required resultant DK orientation. Preferred materials include a polymer or foam base, embedded with conductive fibers/flakes/discs or ferroelectric materials. Such conductive fibers/flakes/discs must be oriented in a specific direction, or in multiple directions to produce the required resultant DK orientation. If fibers are oriented in an X, Y or Z axis, then DK will be oriented in the X, Y, or Z axis, respectively.

Another possibility is to use standard isotropic materials (such as Matsing materials), and then add anisotropic properties to such materials. One example is to layer an isotropic material with anisotropic material in order to create anisotropic properties in one part of the overall material. Typically Matsing materials are chaotically (randomly) distributed, and thus a combination can be used, where 80% of the material is randomly distributed and 20% of the material has a direction (anisotropic)

By mixing materials, one can adjust the overall value of dielectric of the lens. Whereas orientating conductive fibers of a single material would produce a lens with an overall dielectric constant range from 1-2, a mixed material could have a dielectric constant ranging from 1.5-2, or any value between 1 and 2.

Methods

Lenses can be placed in front of elements or antennas, and rotated or otherwise moved in one or more of their X Y Z axes to adjust polarization and other beam parameters. It is contemplated that adjustable parameters include beamwidth, beam-direction, beam polarization, beam gain, and beam sidelobe level.

A single anisotropic lens can be applied to (placed in front of) one or more radiating elements or antennas, with the radiating elements or antennas operative independently or in an arrayed fashion. Multiple anisotropic lens can also be applied to (placed in front of) one or more individual radiating elements or antennas, with the various lenses operating independently or in an arrayed fashion. Beams from one or more radiating elements or antennas can pass through anisotropic lenses serially or in parallel.

Figure 30:
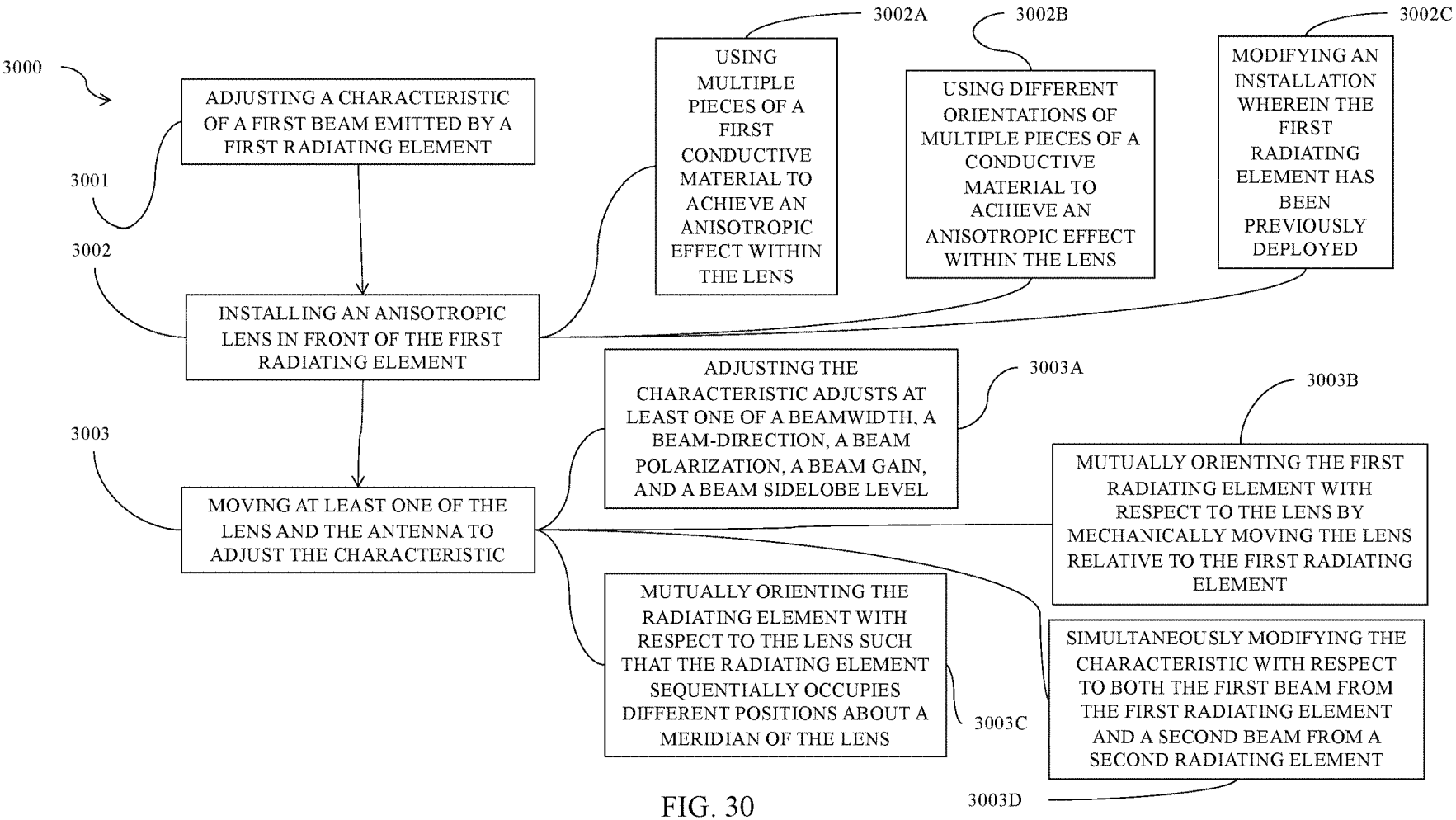
FIG. 30 is a flowchart of a contemplated methods for using anisotropic lenses.

FIG. 30 is a flowchart depicting a method 2500 of variably adjusting a characteristic of a first beam emitted by a first radiating element. The method 2500 comprises installing an anisotropic lens in front of a first radiating element (step 2502), and moving at least one of the lens and the antenna to adjust the characteristic (step 2503).

In some embodiments, method 2500 further includes at least one of using multiple pieces of a first conductive material to achieve an anisotropic effect within the lens (step 2502A) using different orientations of multiple pieces of a conductive material to achieve an anisotropic effect within the lens (step 2502*b*); and modifying an existing installation where the first radiating element has been previously deployed (Step 2502C).

In some embodiments, method 2500 further includes at least one of: adjusting the characteristic further adjusts at least one of a beamwidth, a beam-direction, a beam polarization, a beam gain, and a beam sidelobe level (step 2503*a*); mutually orienting the radiating element with respect to the lens such that the radiating element sequentially occupies different positions about a meridian of the lens (step 2503*c*); mutually orienting the first radiating element with respect to the lens by mechanically moving the lens relative to the first radiating element (step 2303*b*); and modifying the characteristic with respect to both the first beam from the first radiating element, and a second beam from a second radiating element (step 2503D).

The discussion herein provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities of components, properties such as orientation, location, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A communication system, comprising:

a lens configured to be anisotropic with respect to dielectric permittivity;

a first radiating element mutually positionable with respect to the lens such that the first radiating element can alternatively direct a first beam through the lens along a first orientation having a first dielectric permittivity, and a second beam through the lens along a second orientation having a different, second dielectric permittivity;

wherein the first orientation is different than the second orientation, and;

wherein the first beam and the second beam are produced by the first radiating element.

2. The communication system of claim 1, wherein the lens is configured such that the first and second beams have at least one of different beamwidths.

3. The communication system of claim 1, wherein the lens is configured such that the first and second beams have different vertical and horizontal beamwidths.

4. The communication system of claim 1, wherein the lens is configured such that the first and second beams have at least one of different sidelobe levels.

5. The communication system of claim 1, wherein the lens is configured such that the first and second beams have different beam gains.

6. The communication system of claim 1, wherein the lens is configured such that the first and second beams have different beam polarizations.

7. The communication system of claim 1, further comprising a controller configured to control movement of the lens with respect to the radiating element.

8. The communication system of claim 1, further comprising a controller configured to control movement of the radiating element with respect to the lens.

9. The communication system of claim 1, wherein the lens is configured to be anisotropic with respect to dielectric permittivity at least in part due to inclusion within the lens of multiple pieces of at least a first conductive material.

10. The communication system of claim 9, wherein the multiple pieces of the conductive material are fibers having eccentricity of at least 10.

11. The communication system of claim 9, wherein the multiple pieces of the first conductive material are distributed among multiple pieces of a polymeric material.

12. The communication system of claim 9, wherein a first set of the multiple pieces of the first conductive material is oriented diagonally with respect to a second set of the multiple pieces of conductive material.

13. The communication system of claim 9, wherein the lens is configured to be anisotropic at least in part with respect to respective orientations of the multiple pieces of the first conductive material.

14. The communication system of claim 9, wherein the lens is configured to be anisotropic at least in part with respect to different densities of the multiple pieces of the first conductive material.

15. The communication system of claim 9, wherein the lens further includes multiple pieces of a second conductive material, and the lens is configured to be anisotropic at least in part with respect to different regions of the lens having different amounts of the first and second conductive materials.

16. The communication system of claim 1, wherein the lens is configured to be anisotropic with respect to dielectric permittivity at least in part due to the lens having a shape that provides same thicknesses with respect to different beam paths occasioned by the radiating element being mutually positionable with respect to the lens.

17. The communication system of claim 16, wherein the shape is at least partially spherical.

18. The communication system of claim 16, wherein the shape is at least partially cylindrical.

19. The communication system of claim 1, further comprising a second lens, positioned with respect to the first radiating element and the first lens, such that the first beam passes through the first and second lenses, and each of the first and second lenses alters the first beam with respect to at least one of a beamwidth, a beam-direction, a beam polarization, a beam gain, and a beam sidelobe level.

20. The communication system of claim 1, further comprising a second radiating element configured to pass a second output beam through the lens, and wherein mutual movement of the second element with respect to the lens alters the second output beam with respect to at least one of a beamwidth, a beam-direction, a beam polarization, a beam gain, and a beam sidelobe level.

21. The communication system of claim 20, further comprising a controller that combines the first and second beams into a combined beam.

22. A method of variably adjusting a characteristic of a first beam emitted by at least a first radiating element; comprising: installing an anisotropic lens in front of the first radiating element; and moving at least one of the lens and the antenna to adjust the characteristic; wherein the first beam and a second beam are directed by the first radiating element; wherein the first radiating element is configured to direct the first beam along a first orientation, and the second beam along a second, different orientation; wherein the step of moving comprises simultaneously modifying the characteristic with respect to both the first beam and the second beam.

23. The method of claim 22, further comprising using multiple pieces of a first conductive material to achieve an anisotropic effect within the lens.

24. The method of claim 22, further comprising using different orientations of multiple pieces of a conductive material to achieve an anisotropic effect within the lens.

25. The method of claim 22, wherein the step of installing comprises modifying an installation wherein the radiating element has been previously deployed.

26. The method of claim 22, wherein adjusting the characteristic adjusts at least one of a beamwidth, a beam-direction, a beam polarization, a beam gain, and a beam sidelobe level.

27. The method of claim 22, further comprising mutually orienting the radiating element with respect to the lens by mechanically moving the lens relative to the radiating element.

28. The method of claim 22, further comprising mutually orienting the radiating element with respect to the lens such that the radiating element sequentially occupies different positions about a meridian of the lens.

* * * * *